United States Patent [19]

Takeichi

[11] 4,218,126

[45] Aug. 19, 1980

[54] DEVELOPER COLLECTION DEVICE FOR A COPYING MACHINE

[75] Inventor: Fujio Takeichi, Hokkaido, Japan

[73] Assignee: Tokyo Shibaura Denki Kabushiki Kaisha, Kawasaki, Japan

[21] Appl. No.: 26,168

[22] Filed: Apr. 2, 1979

[30] Foreign Application Priority Data

Apr. 19, 1978 [JP] Japan ..... 53/51605[U]

[51] Int. Cl.[2] ..... G03G 15/00; G03G 21/00; G08B 21/00

[52] U.S. Cl. ..... 355/3 R; 222/DIG. 1; 222/413; 340/615; 340/617

[58] Field of Search ..... 355/3 R, 3 DD, 15; 15/100, 256.51, 256.52; 222/413, DIG. 1; 340/615, 617, 665, 668, 676

[56] References Cited

U.S. PATENT DOCUMENTS

| | | | |
|---|---|---|---|
| 3,572,923 | 3/1971 | Fisher et al. | 355/15 |
| 4,030,824 | 6/1977 | Smith | 355/15 |
| 4,172,303 | 10/1979 | Wooding et al. | 15/256.52 |

FOREIGN PATENT DOCUMENTS 53-15660 5/1978 Japan .

*Primary Examiner*—Fred L. Braun

*Attorney, Agent, or Firm*—Cushman, Darby & Cushman

[57] ABSTRACT

A shaft with a spiral blade is supported in a receptacle for receiving a developer removed from the surface of a photosensitive drum. The developer is conveyed toward a collection box during the rotation and movement of the shaft. When an excess load is applied to a screw shaft due to an overflow or blockage of the developer, the shaft is moved in a direction opposite to that in which the developer is conveyed, causing it to abut against a sensor to permit the sensor to be rendered ON.

4 Claims, 3 Drawing Figures

DEVELOPER COLLECTION DEVICE FOR A COPYING MACHINE

BACKGROUND OF THE INVENTION

This invention relates to a developer collection device of a copying machine, which collects a developer remaining on the surface of a photosensitive drum after an image on the surface of a photosensitive drum is transferred to a copying paper.

A developer collection device of this type comprises a removing mechanism for removing a developer remaining on the surface of a photosensitive drum, a receptacle for receiving the developer so removed, a developer collection box disposed at one end portion of the receptacle, and a spiral blade equipped shaft rotatably and axially movably supported in the receptacle such that the developer removed by the removing mechanism can be conveyed toward the developer collection box.

The developer removed by the removing mechanism is collected during the rotation of a shaft toward one end of the shaft and then into the collection box. In a conventional copying machine, the developer is taken out from the collection box when a predetermined number of copying papers are reached.

When the collection time of the developer is determined by the number of copying papers, an amount of developer removed varies dependent upon the size of the copying paper or the copying dnesity. As a result, even if the same number of copying papers are used, an amount of developer recovered differ. There may occur the cases in which, even when the collection box is filled with developer, the operator is not aware of this fact and tries to continue a copying operation. If the copying machine continues to be operated after the collection box is overflowed with the developer, a force opposite to that acting in a direction of conveyance of the developer is applied to the shaft. When such a force is continuously applied to the shaft, the shaft itself and its drive system or the receptacle is injured or broken. If the rotation of the shaft is blocked by a piled-up developer, the developer is coagulated within the receptacle, thereby presenting a maintenance, post-treatment problem etc.

SUMMARY OF THE INVENTION

It is accordingly the object of this invention to provide a developer collection device of a copying machine, which can quickly and positively detect the "developer-filled or-blocked state", thereby preventing an injury or breakage to a screw shaft or its associated parts.

PREFERRED EMBODIMENT OF THE INVENTION

Figure 1:
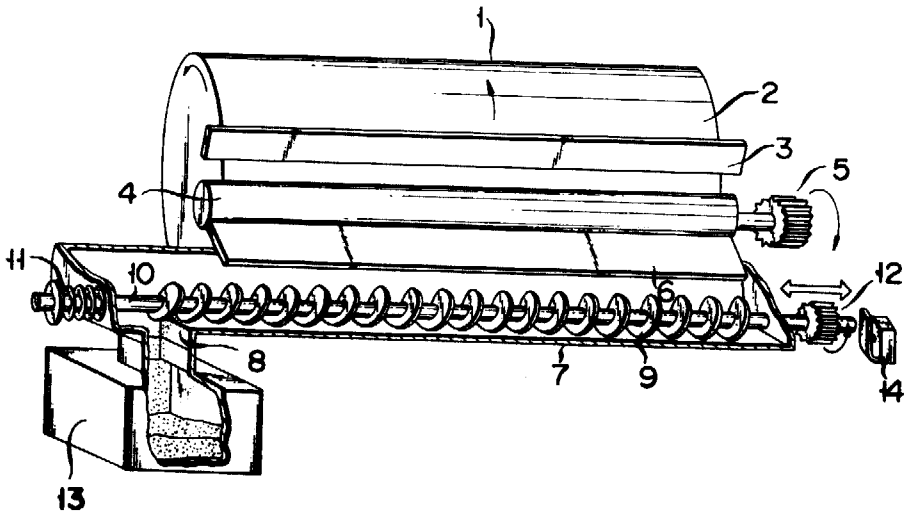
FIG. 1 is a perspective view showing a developer collection device according to this invention.

In FIG. 1, reference numeral 1 shows a photosensitive drum which is rotated in a direction indicated by an arrow. A blade 3 is disposed at proper angle along the axial surface of the photosensitive drum 1 and slidably contacted with the surface of the photosensitive drum 1 such that it can remove a residual developer on the surface 2 of the drum 1 during the rotation of the drum 1 after a transfer operation is completed. A collection roller 4 is disposed below the blade 3 and along the axial surface 2 of the drum 1 and slidably contacted with the surface of the drum 1 to feed the developer removed by the blade 3. A gear 5 is mounted on one end of the collecton roller and can be connected, as required, to a drive mechanism not shown so that it can be rotated in a direction indicated by an arrow in FIG. 1. A blade 6 is disposed at proper angle along the surface of the collection roller 4 and slidably contacted with the surface of the collection roller 4 such that it can remove the developer on the surface of the collection roller 4 during the rotation of the collection roller 4. The angle of the blade is such that the developer removed by the blade 6 is conducted into a receptacle to be later described. The blades 2 and 6 and collection roller 3 constitutes a removing mechanism for removing the developer away from the surface 2 of the photosensitive drum 1.

The developer removed by the removing mechanism is received in the above-mentioned receptacle 7 which is disposed below the blade 6. The receptacle 7 is constructed of a logitudinally extending frame with a developer discharge opening 8 at one end thereof and disposed parallel with the drum 1 and blades 2, 6. In the receptacle 7, a shaft with a longitudinally spiral blade 9 is rotatably supported such that it can be shifted in the longitudinal direction. The spiral blade 9 of the shaft 10 is formed such that the developer is conveyed toward the developer discharge opening of the receptacle 7. At the developer discharge opening side of the receptacle 7 a spring 11 is coiled around one end portion of the shaft 10 to urge the shaft 10 in the direction of conveyance of the developer. A gear 12 is mounted on the other end portion of the shaft 10 and can be connected, as required, to a drive mechanism, not shown, to permit it to be rotated in a direction indicated by an arrow in FIG. 1. A collection box 13 is detachably attched to the developer discharge opening 8 of the receptacle to permit collection of the developer conveyed under the action of the spiral blade 9 of the shaft 10. A sensor 14, such as microswitch, is disposed on the gear 12 side of the shaft 10. When the developer is accumulated within the collection box or at least in the neighborhood of the discharge opening of the shaft 10, an excess load is applied to the spiral blade 9 of the shaft 10 and the end of the shaft abuts against the microswitch 14 to cause the latter to be rendered ON.

Figure 2:
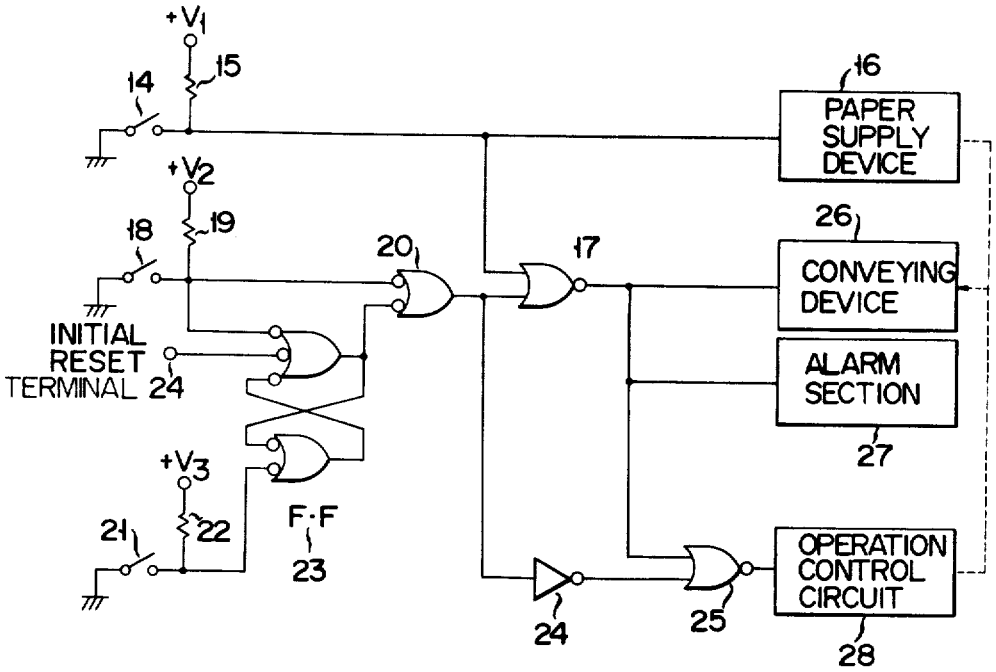
FIG. 2 shows an electric circuit for performing an operation of the developer collection device of FIG. 1.

FIG. 2 shows one form of electric circuit for operating the copying machine equipped with a developer collection device of this invention. In FIG. 2, the microswitch 14 is of a normally open type and is connected at one end of a DC power supply $+V_1$ through a resistor 15 and at the other end grounded. A potential variation on a junction of the resistor 15 and switch 14 which results from the ON-OFF state of the switch is taken as a logical [1] or [0] signal and supplied to a paper supply device 16 and NOR circuit 17. The paper supply device 16 stops its operation when it receives, for example, a logical [1] signal.

A switch 18 is of a normally open type and is disposed on the outlet side of a fixing device on the conveying path and operated by a copied paper which is delivered from the fixing device. The switch 18 is connected at one end to a power supply $+V_2$ through a resistor 19 and at the other end grounded. A potential variation on a junction of the resistor 19 and switch 18 which results from the ON-OFF state of the switch 18 is taken as a logical [1] or [0] signal and supplied to a negated input OR circuit 20. The output of the negated input OR circuit is supplied to the NOR circuit 20.

A switch 21 is of normally open type and is used to start a copying operation. The switch 21 is connected at one end to a DC power supply $+V_3$ through a resistor 22 and at the other end grounded. A voltage variation of a junction between a resistor 22 and switch 21 which results from the ON-OFF state of switch 21 is taken as a logical [1] or [0] signal and supplied to a flip-flop circuit 23 consisting of negated input OR circuits. A signal from an INITIAL RESET terminal 24 and logical [1] or [0] signal from the switch 18 are supplied to the flip-flop circuit 23. A logical [1] or [0] signal of the flip-flop cicuit 23, together with the logical [1] or [0] signal from the switch 18, is supplied to the negated input OR circuit 20. The logical signal of the negated input OR circuit 20 is supplied through the NOR circuit 17 to a NOR circuit 25 and also through the inverter circuit 24 to the NOR circuit 25.

The logical [1] or [0] signal of the NOR circuit 17 is supplied to a conveying device 26, alarm device 27 and NOR circuit 25. The logical [1] or [0] signal of the NOR circuit 25 is supplied to an operation control circuit 28. The conveying device 26 is stopped when it receives a logical [1] signal from the NOR circuit 17. The alarm 27 is operated when it receives a logical [1] signal from the NOR circuit 17. The operation control circuit 28 is operated when it receives a logical [1] signal from the NOR circuit 25.

The operation of the circuit of FIG. 2 will now be explained below.

When the copying machine is normally operated the switch 18 is rendered ON. Since the INITIAL RESET terminal 24 and switch 21 are both in the OFF states, a logical [0] signal of the flip-flop 23 is supplied to the negated input OR circuit 20. When the collection box is filled with the developer and the discharge opening side of the receiver is blocked with the developer, the shaft 10 is moved to the right to cause the switch 14 to be rendered ON. When in this way a logical [1] signal is supplied from the switch 14 the paper supply device 16 is stopped. At the same time, the switch 18 on the conveying path is rendered OFF and thus a logical [0] signal is delivered from the switch 18 to the negated input OR circuit 20. In consequence, the negated input OR circuit produces a logical [0] signal. The logical [0] signal of the negated input OR circuit 20, together with the logical [0] signal from the switch 14, is supplied to the NOR circuit 17. As a result, the NOR circuit delivers a logical [1] signal to the conveying device 26 and alarm 27. The conveying device 26 is stopped and the alarm 27 is operated, showing that the collection box is filled with the developer. At this time, the NOR circuit 25 produces a logical [0] signal and thus the operation of the operation control circuit 28 is stopped.

Figure 3:
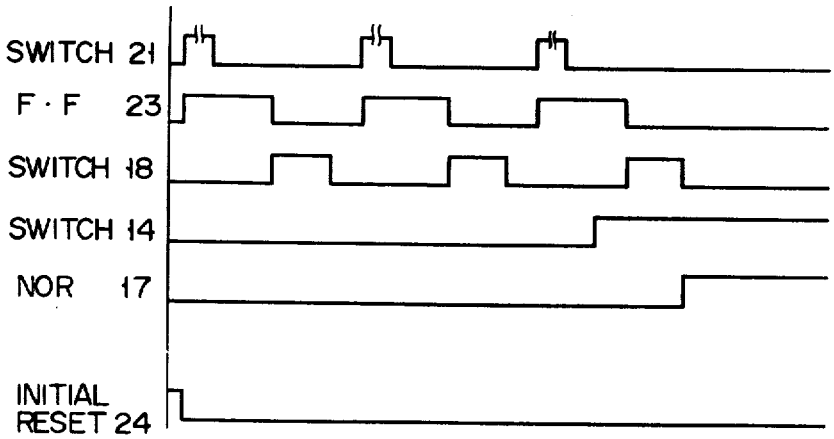
FIG. 3 is a time chart of the parts of the FIG. 2 circuit.

FIG. 3 shows a time chart showing the operation of the circuit of FIG. 2. As will be understood from the time chart, even if the alarm 27 is so designed that it is operated only during the ON time of the switch 14, this invention should not be restricted to the above-mentioned circuit.

The above-mentioned features of this invention permit the "developer-filled" state to be quickly and positively detected. Thus, a safty feature can be provided to various parts or devices of this invention and a high reliability can be obtained without affecting the operation of the copying machine. The direction of conveyance of the developer by the spiral blade of the shaft 10 is the same as the urging direction of the spring, thus alleviating a load applied during the rotation of the shaft.

What is claimed is:

1. A developer collection device for a copying machine, comprising a photosensitive drum, a removing mechanism for removing developer remaining on the surface of the photosensitive drum after a transfer operation is completed, a receptacle having a developer discharge opening at one end portion thereof and adapted to receive the developer removed by the removing mechanism, a shaft rotatably supported in the receptacle and movable in the axial direction thereof, said shaft having a spiral blade at the outer peripheral surface thereof, urging means for urging the shaft, a developer collection box detachably attachable to the developer discharge opening of the recepticle, and a sensor which is rendered ON when said shaft is moved in a direction opposite to the direction of conveyance of the developer into abutment therewith, the movement of the shaft in that direction being affected against an urging force of said urging means when an excess load is applied to the spiral blade of said shaft due to an overflow of the developer from the collection box toward the discharge opening of said receptacle.

2. A developer collection device according to claim 1 in which said spiral blade of said shaft is provided such that the developer of the receptacle is conveyed toward the developer discharge opening of the receptacle.

3. A developer collection device according to claim 1 in which said urging means is urged in the direction in which the developer is conveyed.

4. A developer collection device according to claim 3 in which said urging means is a spring coiled around one end portion of said shaft and located in the discharge opening side of said receptacle.

* * * * *